United States Patent [19]

Aldrich

[11] 4,397,575

[45] Aug. 9, 1983

[54] RIBBON LIFT AND FEED MECHANISM FOR A TYPEWRITER

[75] Inventor: Charles S. Aldrich, Lexington, Ky.

[73] Assignee: International Business Machines Corporation, Armonk, N.Y.

[21] Appl. No.: 305,762

[22] Filed: Sep. 25, 1981

[51] Int. Cl.[3] ..... B41J 32/00; B41J 33/34; B41J 33/04

[52] U.S. Cl. ..... 400/208; 400/211; 400/217; 400/225; 400/248; 400/697.1

[58] Field of Search ..... 400/207, 208, 211–213, 400/216.1, 217, 224, 225, 229, 236, 248, 221.1, 697.1

[56] References Cited

U.S. PATENT DOCUMENTS

| | | | |
|---|---|---|---|
| 2,048,188 | 7/1936 | Clarkson-Jones | 400/217 |
| 3,939,957 | 2/1976 | Bittner | 400/229 |
| 4,242,005 | 12/1980 | Kondur, Jr. | 400/229 |
| 4,297,043 | 10/1981 | Dargatz | 400/248 |
| 4,329,072 | 5/1982 | Kacmarcik | 400/225 |

FOREIGN PATENT DOCUMENTS

| | | | |
|---|---|---|---|
| 38215 | 10/1981 | European Pat. Off. | 400/208 |
| 2045849 | 5/1972 | Fed. Rep. of Germany | 400/211 |
| 2757993 | 6/1979 | Fed. Rep. of Germany | 400/208 |
| 2930115 | 2/1981 | Fed. Rep. of Germany | 400/208 |
| 56-40579 | 4/1981 | Japan | 400/213 |

OTHER PUBLICATIONS

Goff et al., "Printer Ribbon Lift Means", IBM Technical Disclosure Bulletin, vol. 24, No. 3, pp. 1603–1604, 8/81.

Reed, "Ribbon Feeding Device", IBM Technical Disclosure Bulletin, vol. 2, No. 5, p. 5, 2/60.

*Primary Examiner*—William Pieprz

*Attorney, Agent, or Firm*—William J. Dick

[57] ABSTRACT

A ribbon lift and feed mechanism for a typewriter/-printer (10) in which the print ribbon cartridge (15) has deflectable arms (16*a*, 16*b*) for placing the ribbon (13) in a position confronting the platen (11) of the typewriter (10). On the platform (40), supporting the ribbon cartridge (15), is a shuttle (50) which is remotely oscillated as by a drive motor (90) on the frame (12) of the typewriter (10). Translation of the shuttle (50) and the cam (66) associated with the shuttle (50) effects movement of cam follower (66*a*) engageable with the cam (66), causing the deflectable arms (16*a*, 16*b*) of the cartridge (15) to oscillate between a rest and elevated position to place different portions of the print ribbon (13) intermediate the type element (23) and the platen (11). The shuttle (50) also carries ribbon feed drive means (85) which cause an incremental feed of the ribbon (13) after the ribbon has been struck at multiple elevated positions. Moreover, by placing a correction ribbon cartridge (30) beneath the ribbon cartridge (15), another cam (70) on the shuttle can effect platform (40) elevation when it is desired to dispose the correction ribbon (30) intermediate the printing element (23) and the platen (11). This action occurs as a result of the oscillation of the shuttle (50).

9 Claims, 7 Drawing Figures

RIBBON LIFT AND FEED MECHANISM FOR A TYPEWRITER

TECHNICAL FIELD OF THE INVENTION

The present invention relates to ribbon lift and feed mechanism for a moving carrier typewriter/printer in which the platform, supporting the ribbon cartridge, mounts a shuttle which is remotely operated to effect ribbon lift, ribbon feed, and platform elevation and depression.

STATE OF THE PRIOR ART

In impact typewriters (and sometimes impact printers) it is essential that the operator be provided with print line visibility. Consequently, the ribbon is conventionally kept out of the visibility obstruction position and out of the print position except at the time of impact of the implement of printing against the ribbon. Moreover, for ribbon conservation (i.e., maximize the number of characters that may be printed with a ribbon) it is conventional practice to print at various levels on the ribbon. Accordingly means are provided to cause the ribbon to oscillate. When a print ribbon cartridge is employed, it has been conventional practice to place the cartridge on a platform and effect oscillation of the platform, the platform being incorporated in the carrier. For multi-level printing and platform oscillation, see U.S. patent application Ser. No. 801,286 of Schaefer, filed on May 27, 1977, as a continuation of Ser. No. 152,207 now U.S. Pat. No. 4,302,118. With the attendent benefits of a cartridge for holding print ribbon, is the disadvantage of having to oscillate the entire platform upon which the cartridge rests creating mass and therefore momentum or inertia problems. Moreover, in higher speed printers, such as daisy wheel type printers where ribbon oscillation may be increased from three to five times the frequency of the oscillation require in slower typewriter/printers, ribbon feed becomes a problem, usually requiring an on the carrier ribbon feed mechanism as well as print wheel drive means. Conventionally, a motor is utilized for such separate purposes, the motor also being mounted on the carrier. As may be recognized, the motor adds additional weight to the carrier again creating an additional momentum or inertia problem and increasing the necessity for larger carrier drive motors.

Accordingly, it is advantageous to provide means on the carrier which may be operated remotely therefrom for effecting deflection of the ribbon to various print levels for printing on a multiple portion thereof, and to provide light weight means which will permit of remotely operated ribbon feed. In this manner the inertia of the carrier is reduced, making the carrier more easily controllable by light weight, less rugged and therefore less costly motors.

DISCLOSURE OF THE INVENTION

In accordance with the present invention, a shuttle is mounted for translation or oscillation on and beneath the ribbon cartridge platform, the drive means for the shuttle being mounted remotely from the carrier but connected thereto. A cam on the shuttle and a cam follower mounted on the platform in coactive engagement with the cam permits the cam follower to be engaged with deflectable projections on the cartridge for effecting placement of different portions of the ribbon intermediate the print element and the platen depending upon the displacement of the shuttle by the remotely mounted drive means. Moreover, by placing a pivotally mounted pawl on the shuttle, engagement with a ratchet on the platform, dependent upon shuttle position, may be utilized to effect ribbon feed. By employing a double cartridge, i.e., one with correction media or the like beneath the ribbon carrying cartridge, a third cam and cam follower may be activated to effect elevation to an increased level for utilizing the erase capability of the erase media.

The ribbon lift and feed mechanism of the present invention allows for high speed daisy wheel printer or typewriter operation because of the low mass being moved by the ribbon elevation mechanism; the low mass of the shuttle mounted beneath the platform; the decrease in weight of the carrier by being able to operate the motor for the drive and ribbon lift remotely from the carrier; and, the ease of effecting multiple erase or other ribbon feed and lift functions utilizing the novel shuttle arrangement.

One way of carrying out the invention is described in detail below with reference to drawings which illustrate only one specific embodiment, in which.

Figure 1:
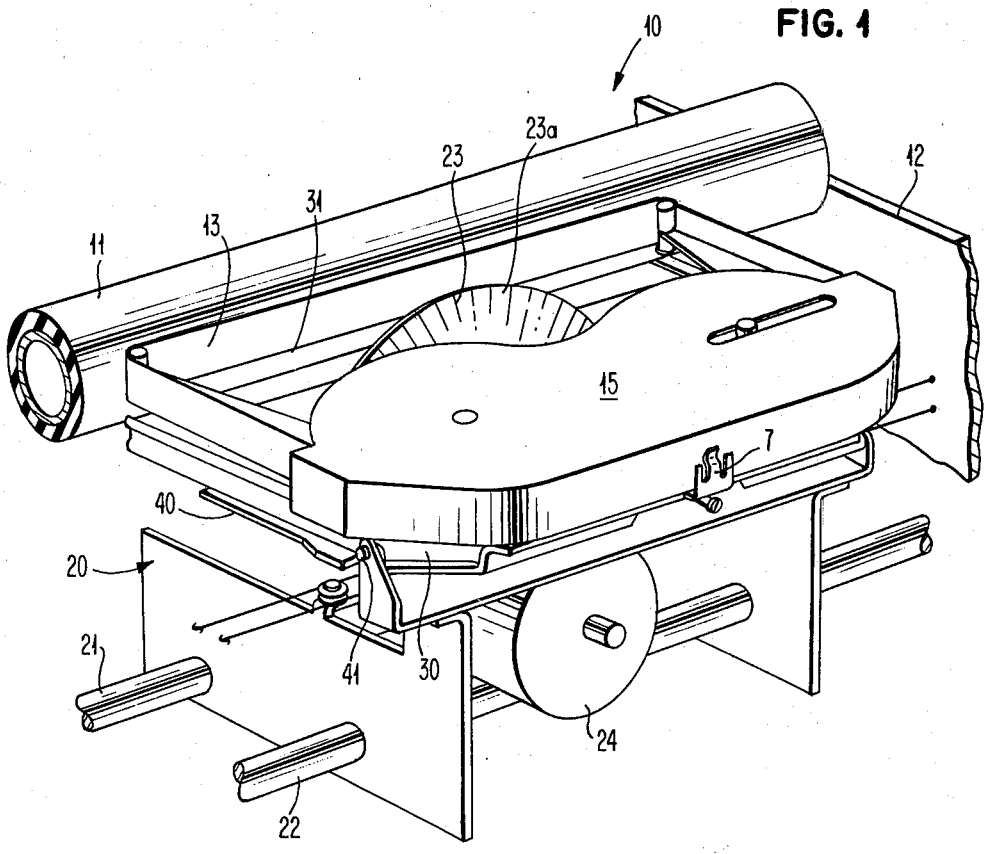
FIG. 1 is a fragmentary perspective view of a typewriter/printer carrier and associated platen incorporating mechanism constructed in accordance with the present invention.

Referring now to the drawing, and especially FIG. 1 thereof, a portion of a typewriter/printer 10 incorporating mechanism constructed in accordance with the present invention, is illustrated therein. The mechanism hereinafter described is equally applicable to a typewriter or printer. As illustrated in FIG. 1, the typewriter/printer 10 includes a typical platen 11 and movable carrier 20, which carries the implements of printing, mounted within the typewriter frame 12. The carrier 20 is displaceable longitudinally of the platen 11 along guide rails 21, 22 to dispose at least a print ribbon 13 from a print ribbon cartridge 15 intermediate a daisy wheel or print wheel 23 and the print receiving media platen 11. The carrier 20 is caused to move along a print line parallel to the platen by drive means, not shown. Rotation of the print wheel 23 is accomplished by the motor 24, and a hammer (not shown) is employed to strike selected indicia carrying spokes **23*a* against the ribbon 13 and thus against paper or other print receiving media held by the platen 11**.

In order to conserve print ribbon 13, it is conventional practice to permit striking of individual indicia carrying spokes **23*a*** against multiple parts of the ribbon 13 in a vertical or elevated mode prior to the ribbon 13 advancing from its supply spool to its take up spool. In high speed printers, it is advantageous to employ low mass moving parts to decrease noise and allow for high speed operation. In the present invention, these objectives are met by moving, in lieu of the entire cartridge 15 about some pivot point during sustained printing operations, just the cartridge arms to present different portions of the ribbon opposite the print line.

CARTRIDGES

The object or advantages of low mass, low noise and high speed operation is accomplished by a ribbon lift mechanism that moves only low mass deflectable arms of the ribbon cartridge during the printing operation. The main body of the cartridge remains stationary with respect to the printing mechanism.

Figure 6:
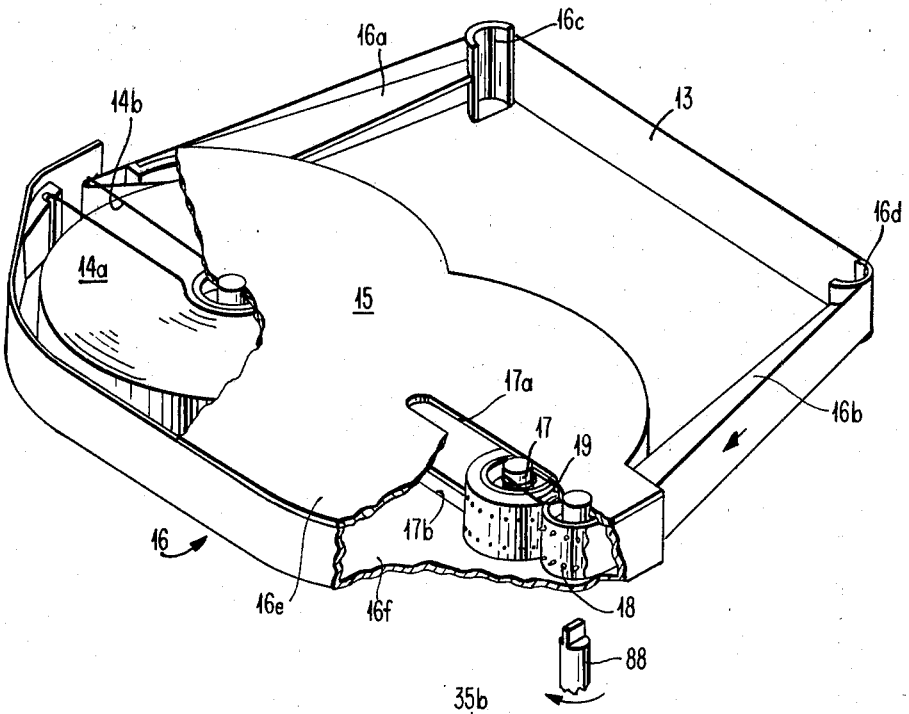
FIG. 6 is a fragmentary perspective view of a ribbon and erase cartridge which may be employed with the example apparatus illustrated in FIGS. 1–5.
Figure 7:
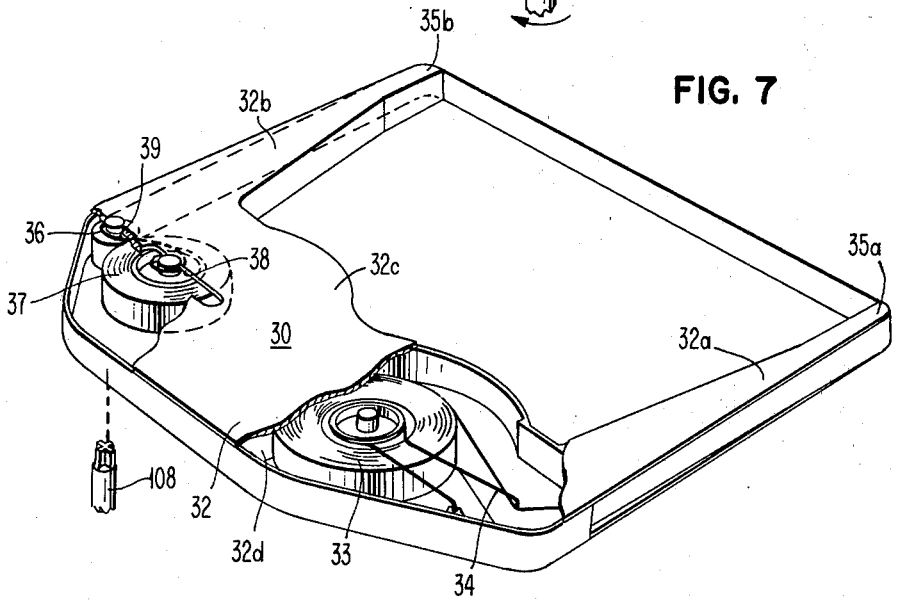
FIG. 7 is a fragmentary bottom view of an erase cartridge and illustrating its drive so that interconnection may be made to the apparatus illustrated best in FIGS. 1 and 3.

In view of the above, and referring now to FIGS. 6 and 7, the ribbon cartridge 15 includes a main body portion 16 having projecting deflectable arms 16*a* and 16*b* to present ribbon 13 intermediate the print element 23 and the platen 11. In the present instance the deflectable arms 16*a*, 16*b* are flexible and cantilevered to the body portion 16 of the cartridge 15. The ribbon 13 extends from a supply spool 14*a* around an extended arm 14*b* of a drag wire, and then around a bearing member, in the illustrated instance a pad 16*c* associated with and at the terminal end of the flexible arm 16*a*. The ribbon 13 then spans the distance between the deflectable arm 16*a* and 16*b* and undergoes a direction change due to the bearing surface of the pad 16*d* integral with the extended terminal end of the deflectable arm 16*b*. The ribbon 13 then enters the body 16 of the cartridge 15 intermediate a fixed but rotatably mounted spike wheel driver 18 for winding upon a take up spool 17. As shown, the take up spool 17 is free to move in a constrained path as by the channels 17*a*, 17*b* in the upper and lower portions 16*e*, 16*f* of the body 16. The take up spool is also pressed against the spiked driver 18 but movable along said guide slots 17*a* and 17*b* by way of the S-shape spring 19. For a more detailed explanation of the operation of the take up spool and associated driver, see U.S. patent application Ser. No. 152,207 and 801,286 to Schaefer, filed on May 22, 1980 and May 27, 1977. For the operation of the spring 19 and its structure, see U.S. patent application Ser. No. 154,681 to Steger, filed on May 30, 1981, both applications being assigned to the assignee of the present invention and herein incorporated by reference.

In the preferred embodiment of the invention, and when the apparatus is to be used as a typewriter, it is preferable that a second cartridge 30 containing erase media or ribbon 31 be interposed between the cartridge 15 and the platform 40 of the carrier 20. To this end, and referring now to FIG. 7, the second cartridge 30 is constructed in a similar manner to the ribbon cartridge 15. However, in the illustrated instance, there is no necessity for projecting flexible arms as the invention incorporates means for effecting platform elevation to position the erase media or ribbon 31 intermediate the print wheel 23 and the platen 11.

As illustrated best in FIG. 7, the second cartridge 30 includes a body portion 32 having a pair of spaced apart projecting arms 32*a*, 32*b* to present erase media or ribbon 31 intermediate the print element 23 and the platen 11. The ribbon 31 extends from a supply spool 33 around a drag wire end 34 and then around the terminal ends 35*a*, 35*b* of the arms 32*a*, 32*b*. The ribbon 31 then enters the body 32 around a fixed or rotatably mounted spiked wheel driver 36 for winding upon a take up spool 37. As illustrated, the take up spool 37 is free to move in a constrained path as by the channel 38 in the upper portion 32*c* of the body 32 and a like channel (not shown) in the lower portion 32*d* of the body 32. The take up spool is also pressed against the spiked driver 36 as by a spring 39 similar in shape and function to the spring 19 associated with the first ribbon cartridge 15.

The cartridges may be separated or attached to one another either permanently or capable of separation by the user. For example, the techniques employed in U.S. Pat. No. 4,239,107 are applicable for placing the two cartridges together. Moreover, the cartridges may be attached either as a unit, or individually placed into a position on the platform to firmly grasp the print ribbon cartridge 15 and press it downwardly so as to capture the erase ribbon cartridge 30 intermediate the platform 40 and the print ribbon cartridge 15. For example, the attachment of the cartridge or cartridge assembly to the platform 40 may be by a flexible, resilient spring catch such as the catch 7 illustrated in FIG. 1. The forward end of the cartridge 15 may be coupled and held to the platform as by rigid hook members such as the hook 9 illustrated in FIG. 3 captured into and by a detent or aperture 9*a* in the body portion 16 of the cartridge. In this connection, a pair of hooks is employed even though the second one is not shown in the drawing. Placing the cartridge 15 with an underlying second cartridge 30 in the platform, biasing the cartridge against the spring member 7 until the platform and lower cartridge 30 are in mating engagement and then releasing the same will permit the hooks 9 to engage the apertures 9*a* of the cartridge 15 causing the cartridge to be grasped and pressed against the platform 40.

RIBBON FEED AND LIFT MECHANISM

On the platform 40, and in order to effect both ribbon lift and ribbon feed, is a shuttle 50 which is remotely oscillated as by a drive motor 90 on the frame of the typewriter. Translation of the shutter effects both deflection of the deflectable arms 16*a*, 16*b* of the cartridge 15 to present different portions of the ribbon 13 intermediate the print element 23 and the platen 11 and to effect, at desired times, feeding of the print ribbon 13. As other portions of the oscillation of the shuttle 50, the platform 40 is elevated to present the erase ribbon 31 to the print element 23 to effect eraser on the print media held by the platen 11.

Figure 3:
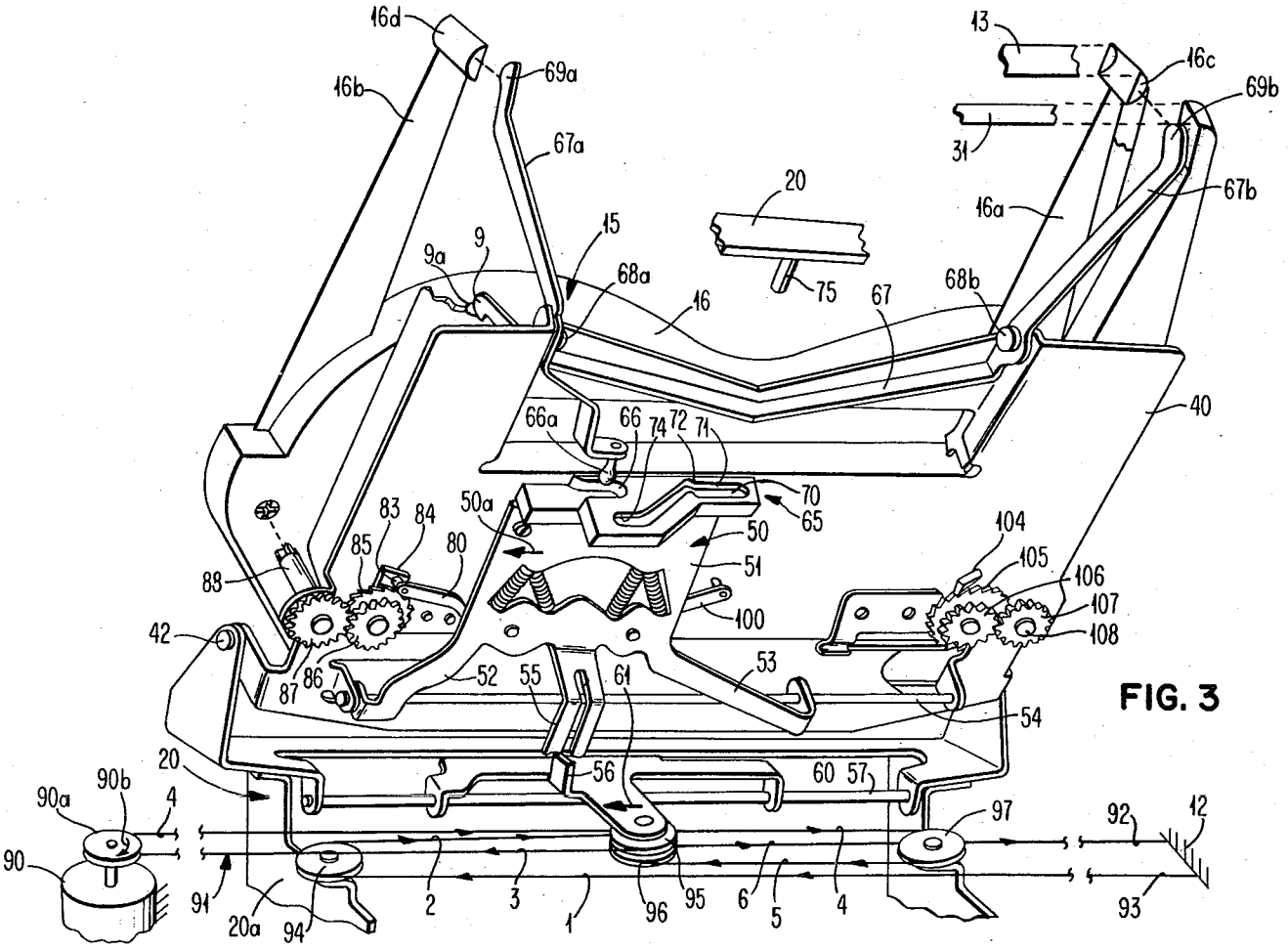
FIG. 3 is a fragmentary perspective view illustrating the apparatus of the present invention as viewed from the underside of the carrier.

To this end, and referring to FIG. 3, the platform 40 is pivotally connected as at pivots 41 and 42 (for pivot 41, see FIG. 1) to the carrier 20 to permit oscillation, under certain conditions to be hereinafter described, of the platform 40.

As set forth above, a shuttle 50 depends from the platform 40 and is mounted for translation generally along an axis parallel to the platen 11. To this end, and as illustrated in FIG. 3, the shuttle 50 includes a body portion 51 and a pair of splayed apart legs 52 and 53 which are mounted for sliding translation or oscillation on a shaft 54. A bifurcated projection 55 is adapted to engage a tab 56 which projects from a movable trolley or the like 60. The trolley is in turn mounted for reciprocation along a second axle or rod 57 affixed to the carrier 20.

In order to effect movement of the trolley 60 along the rod 57, and thus movement of the shuttle 50 as desired to effect both ribbon lift and ribbon feed, the drive means 90 is connected by flexible cable 91 to the trolley. To facilitate the readers understanding of the cabling, directional arrows are placed thereon and each of the strands around the pulleys, hereinafter described, will be numbered with separate numbers.

It should be recognized that there is a single cable 91 with its bitter ends 92 and 93 connected to the frame 12 of the typewriter. Starting at the connection 93 to the frame 12, strand 1 is wrapped around a pulley 94 mounted on the side wall 20*a* of the carrier 20. The cable continues as a strand 2 and wraps around the first pulley 95 of a pulley pair 95 and 96 connected to the trolley 60. The wrap around the pulley 95 results in stand 3 being connected to the motor shaft pulley 90*a* mounted on the drive motor 90. The departing strand 4 of the cable 91 extends from the pulley 90*a* and wraps around a second carrier mounted pulley 97 resulting in strand 5 which extends around the second pulley connected to the trolley, i.e., pulley 96, which leaves the pulley 96 as strand 6 and which is connected to the frame 12 as at 92.

By way of example, assume that the motor pulley 90*a* is rotating in the direction of the arrow 90*b* so that tension on the cable is in the direction of the arrows illustrated on the strands 1–6 as above identified. As strand 4 tends to become longer, while strand 3 tends to become shorter, the trolley 60 will tend to move to the left in the direction of the arrow 61. This causes, because of the tab 56 connected to the bifurcated projection 55, movement of the shuttle 50 to the left or in the direction of arrow 50*a*. In a like manner, when the direction of the rotation of the drive motor is reversed, i.e., in a direction opposite the arrow 90*b*, the distance between the pulley pair 95 and 96 and the pulley 97 mounted on the carrier will tend to grow shorter, causing the trolley 60 to move in the opposite direction of arrow 61. This rotation of the motor 90 causes shuttle 50 movement to the right or opposite the indicated direction of the arrow 50*a*.

It should be recognized that the drive motor 90 may be a stepping motor and, in conjunction with the pulleys 94, 95, 96 and 97 allow for even a more finite reduction in the movement due to the inherent ratio of the cabling system. Moreover, the trolley 60 and shuttle 50 may be composed of light weight metal stampings, which reduce their inertia and mass to allow for rapid shuttle direction reversal while maintaining the drive motor 90 as a light weight motor. In order to effect differing print ribbon 13 position intermediate the print element 23 and the platen 11 to economize on print ribbon usage, the shuttle 50 is provided with a cam block 65, in the illustrated instance including a first cam track 66 and third cam track 70. The first cam track 66 is operative upon reciprocation of the shuttle 50 to effect ribbon lift. To this end, the cam track 66 cooperates with a cam follower 66*a* connected to a yoke 67 which is pivoted as at 68*a*, 68*b* on the platform 40. The yoke 67 includes a pair of legs 67*a*, 67*b* having terminal ends 69*a*, 69*b* which serve to engage the pads 16*d*, 16*c* of the respective flexible arms 16*b* and 16*a* of the cartridge 15. As best illustrated in FIG. 3, the cut of the first cam track 66 is descending from left to right such that when the shuttle moves from right to left the cam follower 66*a* is forced downwardly effecting rotation of the yoke 67 about the pivot 68*a*, 68*b* and causing the flexible arms 16*a*, 16*b* of the cartridge 15 to be elevated. This causes the ribbon 13 to be raised a distance directly proportional to the movement of the shuttle.

Figure 2:
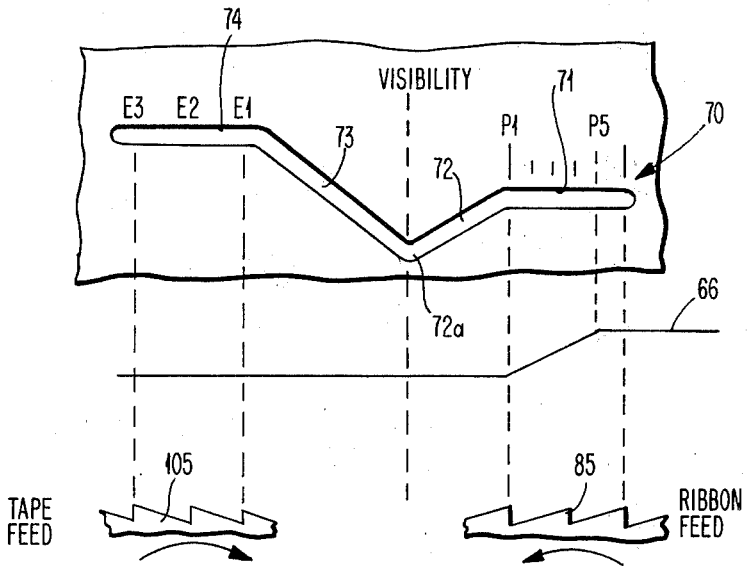
FIG. 2 is a fragmentary enlarged schematic view of a portion of the apparatus constructed in accordance with the present invention.

In FIG. 2, a cam track 66 is shown schematically as being inverted to allow direct correlation with ribbon lift. In this diagram, and for example purposes only, printing may occur at five different levels, i.e., P1–P5, on the ribbon 13.

In order to allow for print line visibility when the typewriter/printer is not printing, as well as to permit of elevation of the platform so as to move the erase ribbon 31 into a position for effecting corrections when called for by the operator, the third cam 70 is operative to control the position of the platform 40 and thus both the print ribbon and the erase ribbon 13 and 31 respectively relative to the platen. To this end, the third cam 70 includes a cam track having a laterally extending, first inactive portion 71 substantially parallel to the axis of the platen 11; a first active portion 72 to effect depression of the platform 40; a second active portion 73 which effects elevation of the platform to align the erase ribbon 31 intermediate the print element 23 and the platen; and a second inactive horizontally extending portion 74 again substantially parallel to the longitudinal axis of the platen 11.

An enlarged schematic diagram of the third cam 70 is illustrated in FIG. 2. It should be noted that the cam track 70 has been rotated 180° about a horizontal axis to relate elevation and depression directly to the actual action of the platform 40. This is true because the cam follower 75 (see FIG. 3) is mounted on the carrier 70 such that the cam track 70 actually follows the fixed follower 75 causing the platform 40 to be raised or depressed following the diagram of FIG. 2. For example, the first inactive portion 71 of the cam track 70 causes no elevation or depression of the platform 40. The first active portion 72 of the cam track 70 causes the platform to be depressed slightly to bring the follower 75 to the apex 72*a* of the track allowing for print line visibility. Moreover, continued movement of the shuttle 50 in the rightward direction (with respect to FIG. 3) will cause the platform 40 to be elevated up the second active cam track portion 73 until the platform is elevated. During the movement of the shuttle 50 in the second inactive portion of the cam track 74, erase ribbon 31 may be fed (as explained hereinafter). In this manner, shuttle movement both to the left and right will effect elevation and/or depression of the platform 40.

During regular high speed printing, there is no reason for the platform to be depressed to the print visibility level as at the apex 72*a* of the cam track 70. Accordingly, all coaction of the cam follower 66*a* with the first cam 66 occurs during the first inactive portion 71 of the cam track 70, the cam track 66 causing the flexible or deflectable arms 16*a*, 16*b* of the ribbon cartridge 15 to be stepped as between print positions P1–P5.

Figure 4:
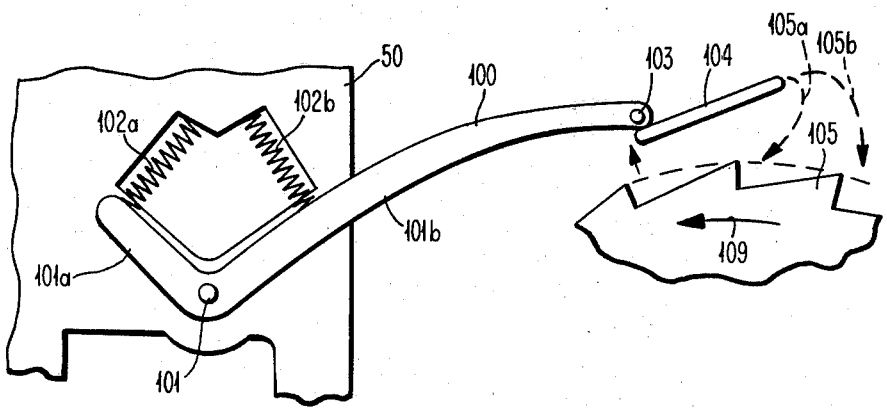
FIG. 4 is an enlarged fragmentary side elevational view of a portion of the apparatus illustrated in FIG. 3.
Figure 5:
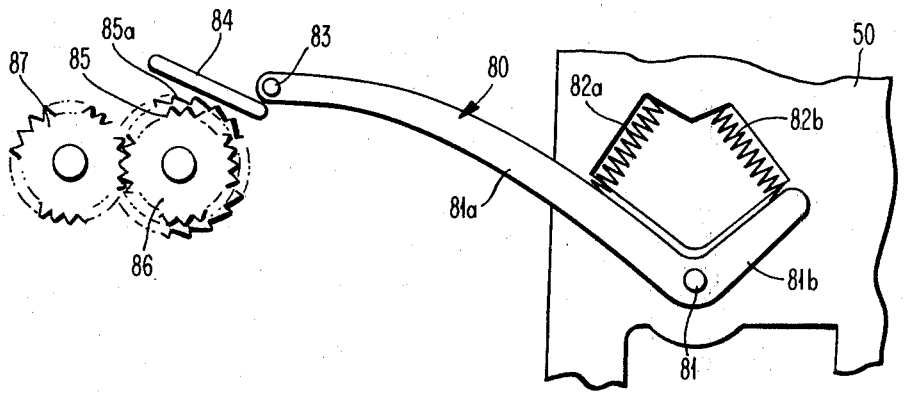
FIG. 5 is a fragmentary sectional view of another portion of the apparatus illustrated in FIG. 3.

In order to effect ribbon feed upon elevation of the print ribbon and exhaustion of the ribbon along a vertical line as it is elevated, the shuttle 50 also carries means for effecting print ribbon movement or feed from the supply spool 14*a* to the take up spool 17. To this end, and referring now to FIGS. 3–5, the shuttle 50 carries a ribbon feed pawl 80 and an erase media or tape pawl 100. Referring first to ribbon feed, the pawl 80 is pivotally mounted to the shuttle 50 as at 81. A pair of springs 82*a*, 82*b* react with the feed pawl arms 81*a*, 81*b* respectively to produce a home rotational position with the spring forces returning the pawl to a stable position such as illustrated in FIG. 5. Movement of the shuttle 50 to the left (reference FIG. 3) causes a projection 83 at the terminal end of arm 81 to engage a second cam surface 84 on the platform 40. Further leftward movement of the shuttle results in rotation of the feed pawl 80 about the pivot 81 compressing spring 82*a* as the projection 83 rides up the cam 84. Upon the projection falling off the upper portion of the cam 84 the spring 82*a* tends to drive the projection 83 into the teeth of a ratchet 85. The projection 83 engages a tooth 85*a* of the ratchet and a reversal of the movement of the shuttle 50 causes rotation of the ratchet. Ratchet 85 rotation effects rotation of an associated gear 86 which meshes with a gear 87. A driver projection 88 connected to gear 87, engages the toothed or spiked driver 18 of the cartridge 15 (see FIG. 6). Further retraction of the shuttle 50 moves the feed pawl 80 underneath the cam 84 and its associated ratchet 85.

An examination of the cam block 65, described above and the first and third cam tracks 66 and 70 illustrate that drive pawl engagement for feeding of ribbon 13 takes place when the cam follower 75 is at the far right end (beyond P5, FIGS. 2 and 3) of the cam track 70.

Thus shuttle 50 withdrawal from that position or rightward movement of the shuttle 50 causes the feeding during portions of the movement when the ribbon is being lowered from its elevated position. Moreover, it should be recognized that one or two teeth of the ratchet 85 may be fed by engagement of the projection 83 with the ratchet teeth 85*a* merely by the length of throw of the drive pawl, i.e., shuttle 50 movement. This will permit, in conjunction with differences in diameter of the spiked driver 18, the feeding of different types of ribbon in the cartridge 15. For example, correctable film ribbon or Tech III ribbon may be fed solely dependent upon the diameter of the spiked driver 18 and the proper rotation of the motor 90.

If the apparatus is to be employed as a typewriter, it is desirable that the operator have the ability to place an erase ribbon 31 opposite the print point intermediate the petal wheel 23 and the platen 11. To this end, and referring now to FIGS. 3 and 4, rotating the pulley 90*a* of the motor 90 in a direction opposite to that of the arrow 90*b* will effect trolley 60 movement to the right causing the shuttle 50 to move to the right (relative to FIG. 3). In this mode, as the shuttle 50 moves to the right the cam follower 66*a* will be disengaged from the first cam track or first cam 66. However, the platform 40 will be elevated due to the following of the cam follower 75 in the second cam track 70. That is, and referring to FIG. 2, relative movement between the cam follower and the cam will cause the cam to track the first inactive portion 71, the first active portion 72 which will tend to depress the platform 40, and then up the second active portion 73 into the second inactive portion 74. In this manner, the platform 40 will be elevated to position the media correction ribbon 31 intermediate the platen 11 and the indicia carrying spokes 23*a* of the daisy wheel or print wheel 23.

In order to increment or feed the correction ribbon 31, a similar structure is employed associated with the shuttle 50 and platform 40 to that heretofore described relative to the print ribbon feed. For example, and referring now to FIGS. 3 and 4, a second pawl driver 100 having a pivot point 101 on the shuttle 50 is biased into a stable position as by springs 102*a*, 102*b* pressing against arms 101*a*, 101*b* of the pawl driver 100. As shown in FIG. 4, the terminal end of the pawl driver 100 includes a projection 103 which, when the shuttle moves to the right, engages a camming surface 104 mounted on the carrier platform 40. As the projection 103 rides up the cam 104, because of the rightward movement of the shuttle 50, the pawl driver pivots biasing the spring 102*b* in compression and placing the spring 102*a* in tension. When the shuttle 50 reaches a predetermined position the projection 103 falls off the inclined cam 104 and the springs 102*a*, 102*b* cause the pawl driver 100 to engage the teeth of the ratchet wheel 105. As illustrated in FIG. 3, the ratchet wheel 105 is connected to a drive gear 106 which in turn meshes with a driven gear 107. The driven gear 107 includes a driver projection 108 which passes therefrom through the platform 40. The driver projection 108 engages the spiked driver 36 of the correction cartridge 30 so that upon shuttle movement to the left (relative to FIG. 3) the projection 103 effects rotation in the direction of the arrow 109 (FIG. 4) of the ratchet 105 causing correction ribbon 31 feed.

It should be recognized that both ribbon 13 and tape 31 feed may be altered to obtain one or two ratchet teeth feed, as desired, (see FIG. 4 and arrows 105*a*, 105*b*) merely by increasing shuttle 50 movement.

Thus the ribbon lift and feed mechanism of the present invention allows for high speed daisy wheel printer or typewriter operation due to the low mass being moved by the ribbon elevation and feeding mechanism. Notably the low mass of the shuttle mounted beneath the platform, the decrease in weight of the carrier by being able to operate the motor for the drive and ribbon lift remotely from the carrier and the ease of effecting multiple erase or other ribbon feed and lift operations utilizing the simple shuttle arrangement.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. A ribbon lift and feed mechanism for a typewriter/-printer, comprising in combination:

a platen, a carrier mounting implements of printing thereon and moveable along a print line parallel to said platen;

a platform on said carrier for supporting at least a ribbon cartridge, said ribbon cartridge having a pair of spaced apart, deflectable projections for disposing ribbon along the said print line intermediate a print element and said platen;

a shuttle depending from said platform and mounted for translation relative thereto;

drive means mounted remotely from said carrier and connected to said shuttle to effect translation of said shuttle relative to said platform;

a cam on said shuttle and a cam follower mounted on said platform in coactive engagement with said cam, said cam follower including means engageable with said deflectable projections on said cartridge for effecting placement of different portions of said ribbon intermediate said print element and said platen depending upon the displacement of said shuttle by said drive means.

2. A ribbon lift and feed mechanism for a typewriter/-printer in accordance with claim 1 including a pivotally mounted pawl on said shuttle;

a ratchet on said platform, means connected to said ratchet for connection to said ribbon cartridge to effect ribbon feed upon predetermined shuttle translation and engagement of said pawl with said ratchet.

3. A ribbon lift and feed mechanism for a typewriter/-printer in accordance with claim 2 including second cam means mounted on said platform to cam said pawl away from said ratchet until a predetermined shuttle displacement has occurred, and then to effect ribbon feed upon shuttle displacement in the opposite direction.

4. A ribbon lift and feed mechanism for a typewriter/-printer in accordance with claims 2 or 3 including biasing means for said pawl to urge said pawl into a home position.

5. A ribbon lift and feed mechanism in accordance with claim 3 including a second ribbon cartridge intermediate said ribbon cartridge and said platform, a third cam on said shuttle and a cam follower on said carrier engageable with said third cam; and pivot means pivotally connecting said platform to said carrier;

said third cam having a first inactive portion during said first mentioned ribbon lift and feed and a second active portion for effecting platform elevation upon predetermined shuttle movement in a predetermined direction, said second active portion of said third cam being dimensioned for second ribbon cartridge ribbon position intermediate said print element and said platen.

6. A ribbon lift and feed mechanism in accordance with claim 5 including a first active portion of said third cam, intermediate said first inactive portion, said second active portion to effect depression of said platform about said pivot means for effecting print line visibility.

7. A ribbon lift and feed mechanism in accordance with claim 5 including a second pawl and ratchet, said second pawl being mounted on said shuttle and said second ratchet being mounted said platform, means interconnecting said second ratchet with said second ribbon cartridge, and a second inactive portion on said third cam connected to said second action portion to allow maintenance of said platform at an elevated level during movement of said shuttle in said predetermined direction to effect pawl engagement of said ratchet and second ribbon feed when said shuttle movement is reversed.

8. A ribbon lift and feed mechanism in accordance with claim 7 including another cam mounted on said platform to cam said second pawl away from said ratchet until a predetermined shuttle displacement has occurred, and then to effect ribbon feed upon shuttle displacement in a direction opposite to said predetermined direction.

9. A ribbon lift and feed mechanism for a typewriter/-printer, comprising in combination:

a platen, a carrier mounting implements of printing thereon and moveable along a print line parallel to said platen;

a platform on said carrier for supporting at least a ribbon cartridge, said ribbon cartridge having a pair of spaced apart, deflectable projections for disposing ribbon along said print line intermediate a print element and said platen;

a shuttle depending from said platform and mounted for translation relative thereto;

drive means mounted remotely from said carrier and connected to said shuttle to effect translation of said shuttle relative to said platform;

means responsive to shuttle translation for effecting deflection of said deflectable arms, and further means responsive to a predetermined shuttle translation for effecting ribbon feed.

* * * * *